US009428700B2

(12) United States Patent
Koseoglu

(10) Patent No.: US 9,428,700 B2
(45) Date of Patent: Aug. 30, 2016

(54) HYDROVISBREAKING PROCESS FOR FEEDSTOCK CONTAINING DISSOLVED HYDROGEN

(71) Applicant: Saudi Arabian Oil Company, Dhahran (SA)

(72) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 420 days.

(21) Appl. No.: 13/974,822

(22) Filed: Aug. 23, 2013

(65) Prior Publication Data

US 2014/0054199 A1 Feb. 27, 2014

Related U.S. Application Data

(60) Provisional application No. 61/692,883, filed on Aug. 24, 2012.

(51) Int. Cl.
*C10G 47/00* (2006.01)
*C10G 47/22* (2006.01)

(52) U.S. Cl.
CPC ..... *C10G 47/00* (2013.01); *C10G 47/22* (2013.01)

(58) Field of Classification Search
CPC ..... C10G 9/007; C10G 47/00
See application file for complete search history.

(56) References Cited

U.S. PATENT DOCUMENTS

| | | | |
|---|---|---|---|
| 2,366,218 | A | 1/1945 | Ruthruff |
| 2,717,230 | A | 9/1955 | Murray et al. |
| 2,762,754 | A | 9/1956 | Offutt et al. |
| 2,873,245 | A | 2/1959 | Thompson at al. |
| 3,089,843 | A | 5/1963 | Eastman et al. |
| 3,132,088 | A | 5/1964 | Beuther et al. |
| 3,148,135 | A | 9/1964 | Schlinger et al. |
| 3,271,302 | A | 9/1966 | Gleim et al. |
| 3,532,618 | A | 10/1970 | Wunderlich at al. |
| 3,691,058 | A | 9/1972 | Hamner et al. |
| 3,707,459 | A | 12/1972 | Mason et al. |
| 3,806,444 | A | 4/1974 | Crouch et al. |
| 3,888,937 | A | 6/1975 | Siskin et al. |
| 4,005,006 | A | 1/1977 | Montagna |
| 4,017,379 | A | 4/1977 | Iida et al. |
| 4,029,571 | A | 6/1977 | Curtin |
| 4,391,700 | A | 7/1983 | Billon et al. |

(Continued)

FOREIGN PATENT DOCUMENTS

| | | |
|---|---|---|
| DE | 3826226 A1 | 3/1989 |
| EP | 0 048 098 A2 | 3/1982 |

(Continued)

OTHER PUBLICATIONS

International Search Report and Written Opinion PCT/US2013/056419, Dec. 3, 2013 (11 pages).

*Primary Examiner* — Michelle Stein
(74) *Attorney, Agent, or Firm* — Abelman, Frayne & Schwab

(57) ABSTRACT

An improved hydrovisbreaking process for reducing the viscosity of a liquid hydrocarbon feedstock is provided. A substantially single-phase hydrogen-enriched liquid hydrocarbon feedstock is obtained by mixing the feedstock with hydrogen gas and flashing off the excess hydrogen gas. Comparatively smaller reactor vessels can be used without a gas recycle system, thus reducing the capital cost of hydrovisbreaking process. Further the need for cutter stocks can be minimized or eliminated.

17 Claims, 5 Drawing Sheets

(56) References Cited

U.S. PATENT DOCUMENTS

| | | | | |
|---|---|---|---|---|
| 4,411,770 | A | 10/1983 | Chen et al. | |
| 4,481,101 | A * | 11/1984 | Yan | C10G 1/065 208/106 |
| 4,487,687 | A | 12/1984 | Simo et al. | |
| 4,504,377 | A | 3/1985 | Shu et al. | |
| 4,544,479 | A | 10/1985 | Yan | |
| 4,587,007 | A | 5/1986 | Rudnick | |
| 4,615,791 | A | 10/1986 | Choi et al. | |
| 4,708,784 | A | 11/1987 | Howell et al. | |
| 4,764,270 | A | 8/1988 | Hsieh et al. | |
| 4,802,972 | A | 2/1989 | Kukes et al. | |
| 4,892,644 | A | 1/1990 | Choi et al. | |
| 5,045,179 | A | 9/1991 | Langhoff et al. | |
| 5,372,705 | A | 12/1994 | Bhattacharya et al. | |
| 5,460,714 | A | 10/1995 | Fixari et al. | |
| 5,688,395 | A * | 11/1997 | Carrazza | C10G 47/32 208/121 |
| 7,001,502 | B1 * | 2/2006 | Satchwell | C10G 45/00 208/210 |
| 7,291,257 | B2 | 11/2007 | Ackerson et al. | |
| 2009/0000986 | A1 | 1/2009 | Hassan et al. | |
| 2009/0272671 | A1 | 11/2009 | Keusenkothen et al. | |

FOREIGN PATENT DOCUMENTS

| | | | |
|---|---|---|---|
| EP | 0175 511 | A1 | 8/1985 |
| WO | 97/29841 | A2 | 8/1997 |
| WO | 2012058396 | A2 | 5/2012 |
| WO | 2012059805 | A1 | 5/2012 |
| WO | 2013019320 | A1 | 2/2013 |

* cited by examiner

HYDROVISBREAKING PROCESS FOR FEEDSTOCK CONTAINING DISSOLVED HYDROGEN

RELATED APPLICATIONS

This application claims the benefit of U.S. Provisional Patent Application No. 61/692,883 filed Aug. 24, 2012, the disclosure of which is hereby incorporated by reference.

BACKGROUND OF THE INVENTION

1. Field of the Invention

This invention relates to improvements in reduction of viscosity of heavy residua, and in particular to an improved hydrovisbreaking process and apparatus.

2. Description of Related Art

Heavy residua such as atmospheric or vacuum residues generally require varying degrees of conversion to increase their value and usability, including the reduction of viscosity to facilitate subsequent refining into light distillates products such as gasoline, naphtha, diesel and fuel oil. One approach to reduce the viscosity of heavy residua is to blend heavy residua with lighter oil, known as cutter stocks, to produce liquid hydrocarbon mixtures of acceptable viscosity. However, this has the disadvantage of consuming valuable, previously fractioned liquid hydrocarbon mixtures.

Other processes for conversion of heavy residua into light distillates and reduction in the viscosity include catalytic processes such as fluid catalytic cracking, hydrocracking, and thermal cracking processes such as visbreaking or coking. These processes increase the product yield and reduce the requirement for valuable cutter stock as compared to blending alone.

Thermal cracking processes are well established and exist worldwide. In these processes, heavy gas oils or vacuum residues are thermally cracked in reactors which operate at relatively high temperatures (e.g., about 425° C. to about 540° C.) and low pressures (e.g., about 0.3 bars to about 15 bars) to crack large hydrocarbon molecules into smaller, more valuable compounds.

Visbreaking processes reduce the viscosity of the heavy residua and increase the distillate yield in the overall refining operation by production of gas oil feeds for catalytic cracking. To achieve these goals, a visbreaking reactor must be operated at sufficiently severe conditions to generate sufficient quantities of the lighter products.

There are two types of visbreaking technologies that are commercially available: 'coil' or 'furnace' type processes and 'soaker' processes. In coil processes, conversion is achieved by high temperature cracking for a predetermined, relatively short period of time in the heater. In soaker processes, which are low temperature/high residence time processes, the majority of conversion occurs in a reaction vessel or a soaker drum, where a two-phase effluent is maintained at a comparatively lower temperature for a longer period of time.

Visbreaking processes convert a limited amount of heavy oil to lower viscosity light oil. However, the asphaltene content of heavy oil feeds severely restricts the degree of visbreaking conversion, likely due to the tendency of the asphaltenes to condense into heavier materials such as coke, thus causing instability in the resulting fuel oil.

Certain visbreaking processes which incorporate hydrogen gas in the thermal process to convert heavy oils, known as hydrovisbreaking, not only thermally crack the molecules into less viscous compounds, but also serve to hydrogenate them. The temperature and pressure of hydrogenation increase with increasing average molecular weight of the feedstock to be converted.

In conventional hydrovisbreaking processes, liquid-gas two-phase unit operations are required, thus necessitating relatively large reaction vessels and gas recycle system. This adds substantial capital investment and processing costs to the hydrovisbreaking operation, thereby minimizing fundamental advantages of hydrovisbreaking, i.e., lowering viscosity while reducing the quantity of cutter stock required.

Therefore, a need exists for improved processes for converting heavy residua.

SUMMARY OF THE INVENTION

The present invention broadly comprehends improvements in process for the reduction of viscosity of heavy residua, and in particular to an improved hydrovisbreaking process and apparatus.

Herein provided is an improved visbreaking process for converting heavy residua that avoids condensation of asphaltenes and contamination, and that can be practiced in relatively smaller reaction vessels requiring lower capital investment as compared to conventional hydrovisbreaking processes, and minimizing or eliminating the need for gas recycle system(s) and use of conventional cutter stocks.

In accordance with one embodiment, the process for reducing the viscosity of a liquid hydrocarbon feedstock in a hydrovisbreaking reaction zone comprises:

a. mixing the liquid hydrocarbon feedstock and an excess of hydrogen gas in a mixing zone to dissolve a portion of the hydrogen gas in the liquid hydrocarbon feedstock and produce a two-phase mixture of a hydrogen-enriched liquid hydrocarbon feedstock and the remaining excess hydrogen gas;

b. introducing the mixture of hydrogen gas and the hydrogen-enriched liquid hydrocarbon feedstock into a flashing zone under predetermined conditions to separate the undissolved excess hydrogen gas and optimize the amount of hydrogen dissolved in the hydrogen-enhanced liquid hydrocarbon feedstock, and recovering a single-phase hydrogen-enriched liquid hydrocarbon feedstock;

c. conveying the single-phase hydrogen-enriched liquid hydrocarbon feedstock under conditions that maximize the amount of dissolved hydrogen in the hydrocarbon feedstock into a hydrovisbreaking reaction zone in the presence of steam to crack the feedstock into relatively smaller molecules; and d. recovering converted hydrocarbon products of reduced viscosity from the hydrovisbreaking reaction zone.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are included to provide illustration and a further understanding of the various aspects and embodiments. The drawings, together with the remainder of the specification, serve to explain principles and operations of the described and claimed aspects and embodiments.

BRIEF DESCRIPTION OF THE DRAWINGS

The foregoing summary as well as the following detailed description will be best understood when read in conjunction with the attached drawings. It should be understood, however, that the invention is not limited to the precise arrangements and apparatus shown. In the drawings the same or similar reference numerals are used to identify to the same or similar elements, in which.

DETAILED DESCRIPTION OF THE INVENTION

In accordance with the process described herein, gas phase hydrogen is essentially eliminated by dissolving hydrogen in the liquid hydrocarbon feedstock and flashing the feedstock under predetermined conditions upstream of the hydrovisbreaking reactor to produce a substantially single-phase hydrogen-enriched liquid hydrocarbon feedstock. Dissolved hydrogen in the liquid hydrocarbon feedstock enhances conventional hydrovisbreaking processes by stabilizing free radicals formed during the cracking reactions, resulting in reduced coke formation and improved product yield quality. In addition, the benefits of hydrovisbreaking can be attained while minimizing or eliminating the need for gas recycle system(s) and typically large reactors dimensioned and constructed to accommodate a two-phase liquid-gas system.

Figure 1:
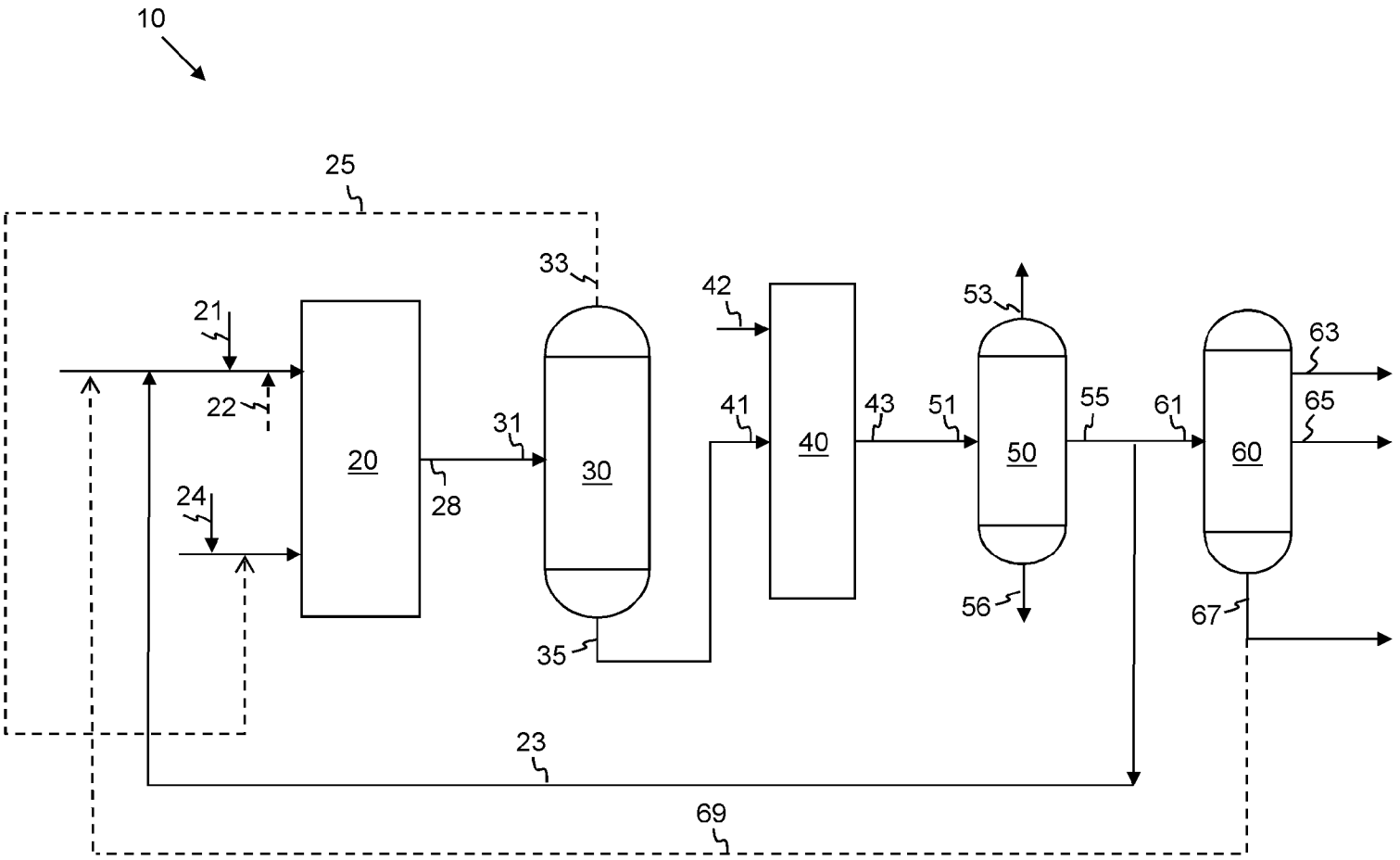
FIG. 1 is a process flow diagram of a hydrovisbreaking operation according to the process described herein.

FIG. 1 is a process flow diagram of one embodiment of a process and system described herein for hydrovisbreaking. System 10 generally includes a series of unit operations that facilitate cracking of heavy hydrocarbon feedstocks into lighter and less viscous blends. In particular, system 10 includes a mixing unit 20, a flashing unit 30, a hydrovisbreaking reactor 40, a separation unit 50 and a fractionating unit 60.

Mixing unit 20 includes a feed inlet for receiving fresh feedstock via conduit 21, recycled liquid hydrocarbon products from separation unit 50 via conduit 23, and, optionally, a homogeneous catalyst via conduit 22, and a portion of heavy bottom product recycled from the fractionating unit 60 via conduit 69. Mixing unit 20 also includes a gas inlet for receiving make-up hydrogen gas via conduit 24 and/or recycled hydrogen gas from flashing unit 30 via conduit 25. As will be apparent to one of ordinary skill in the art, fewer or more inlets can be provided in the mixing vessel 20, such that influent streams can be introduced into the mixing unit through common or separate inlets. The feed inlet can be located at the bottom of the mixing unit as inlet 102*a* shown in FIG. 2A, or at the top of the mixing unit as inlet 102*b* shown in FIG. 2B.

Figure 2B:
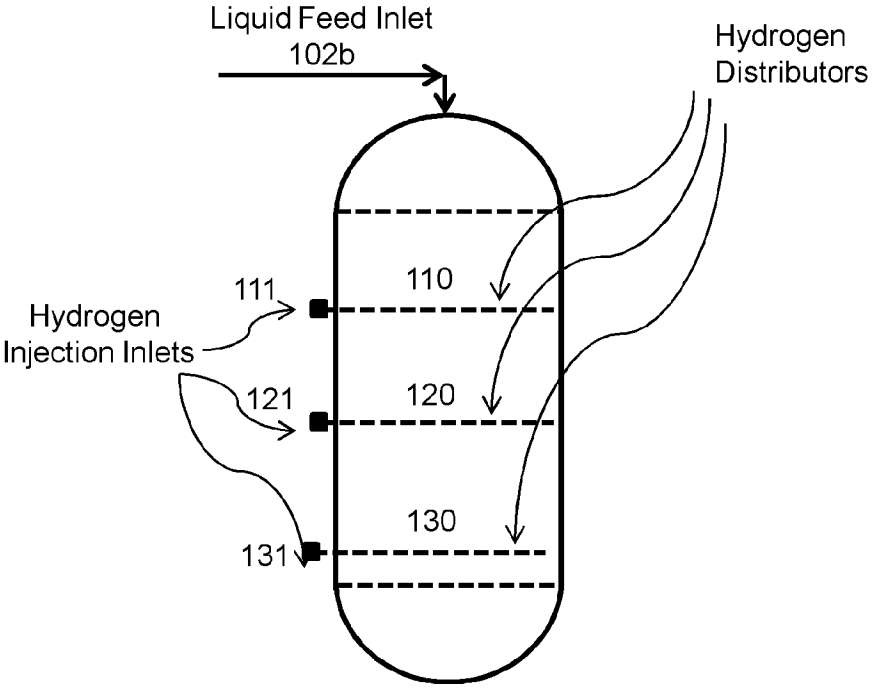
FIGS. 2A and 2B are schematic diagrams of mixing units for use with the apparatus of FIG. 1.
Figure 2A:
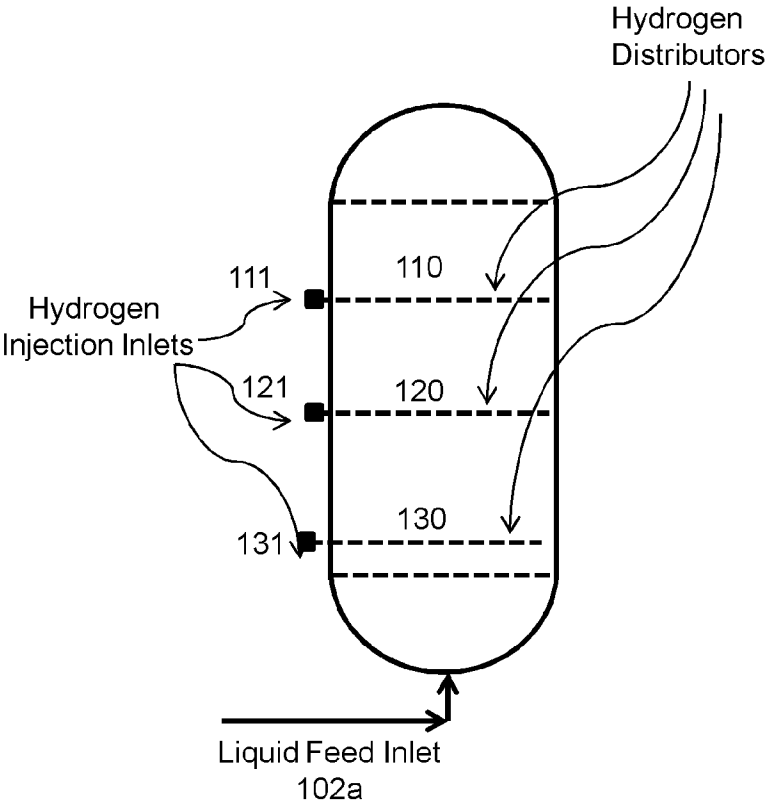
Figure 3:
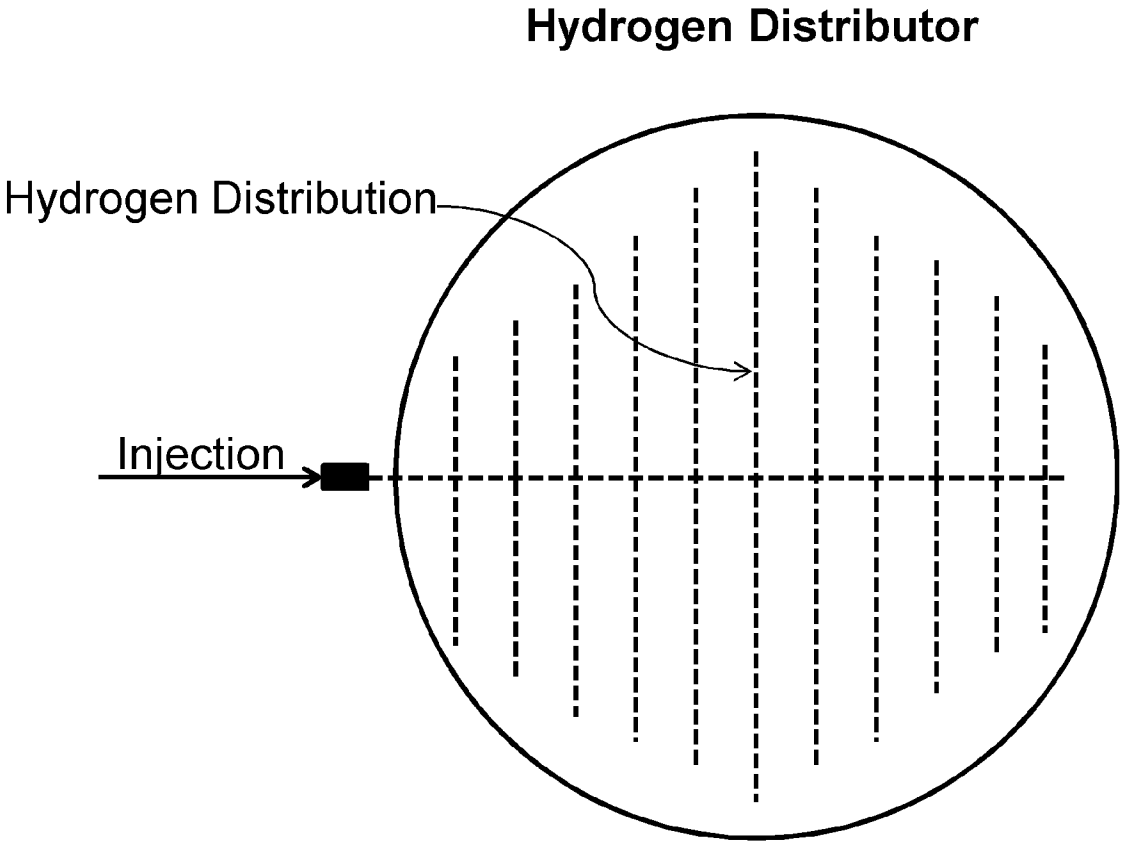
FIG. 3 is a schematic diagram of a hydrogen distributor suitable for use with the mixing units of FIGS. 2A and 2B.

In certain embodiments, such as the mixing unit shown in FIGS. 2A and 2B, hydrogen gas is introduced via a plurality of hydrogen injection inlets 111, 121, and 131 and a plurality of hydrogen distributors 110, 120 and 130 along the height throughout the mixing unit, at least one of which is positioned proximate the bottom of the mixing unit. Hydrogen gas is injected through hydrogen distributors into the mixing unit, as shown in FIG. 3, for intimate mixing with the feedstock to maximize the dissolved hydrogen content and preferably to efficiently achieve saturation.

Figure 4:
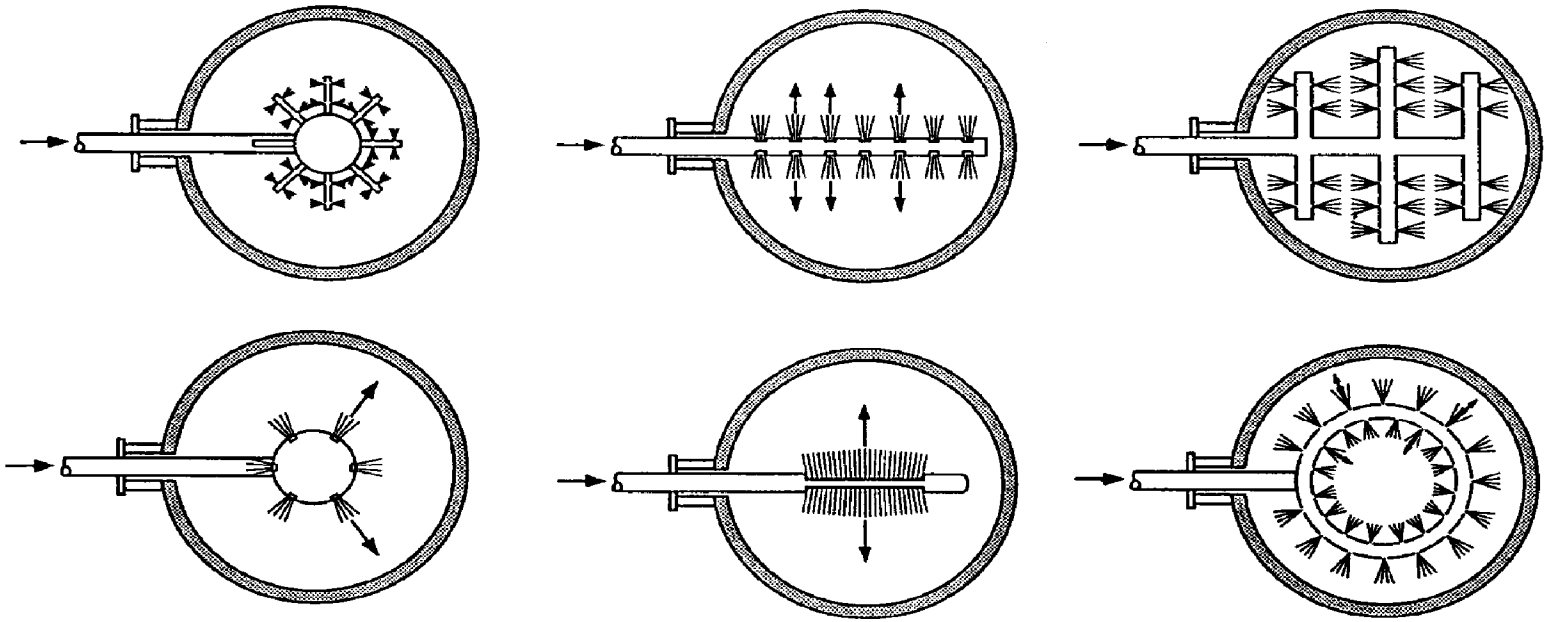
FIG. 4 are schematic diagrams of plural constructions and arrangements of hydrogen distributors suitable for use with the mixing units of FIGS. 2A and 2B.

Various types of hydrogen distribution apparatus can be used. FIG. 4 shows a plurality of designs for gas distributors which can include tubular injectors or manifolds fitted with nozzles and/or jets. These apparatus are configured and dimensioned to uniformly distribute hydrogen gas into the flowing hydrocarbon feedstock in the mixing unit 20 in order to efficiently dissolve hydrogen gas in the feedstock.

In certain embodiments, the feed inlet is positioned above the gas inlet(s) for optimized mixing when the liquid flows down and the gas travels up, i.e., counter-current flow. Mixing unit 20 further includes an outlet 28 for discharging a two-phase mixture of hydrogen gas and hydrogen-enriched liquid hydrocarbon feedstock.

Flashing unit 30 includes an inlet 31 in fluid communication with outlet 28 of mixing unit 20 for receiving the two-phase mixture containing an excess of hydrogen gas and hydrogen-enriched liquid hydrocarbon feedstock, an outlet 33 in fluid communication with an optional conduit 25 for recycling hydrogen gas, and an outlet 35 for discharging a substantially single-phase hydrogen-enriched liquid hydrocarbon feedstock.

Hydrovisbreaking reactor 40 includes an inlet 41 in fluid communication with outlet 35 for receiving the substantially single-phase hydrogen-enriched liquid hydrocarbon feedstock, an inlet 42 for receiving water or steam, and an outlet 43 for discharging a cracked intermediate product.

Separation unit 50 includes an inlet 51 in fluid communication with outlet 43 for receiving the cracked intermediate product, an outlet 53 for discharging light gases, an outlet 55 for discharging the liquid hydrocarbon products of reduced viscosity and an outlet 56 for discharging water. Separation unit 50 may include a high pressure hot separator and/or an air cooler and/or low pressure two and/or three-phase separators. A portion of the liquid hydrocarbon product stream is recycled back to the mixing unit 20 via conduit 23 to improve the solubility of hydrogen in the liquid feedstock. This integrated system eliminates or substantially reduces the need for an external source of cutter stock as required in processes of the prior art. An external source of light hydrocarbon can optionally be provided to the mixing unit 20 at start-up of the system to improve the hydrogen solubility.

Fractionating unit 60 includes an inlet 61 in fluid communication with outlet 55 for receiving at least a portion of the liquid hydrocarbon products, an outlet 63 for discharging a light product, an outlet 65 for discharging an intermediate product and an outlet 67 for discharging a heavy bottom product. A portion of the heavy bottom product can be recycled to the mixing unit 20 for further treatment.

Figure 5:
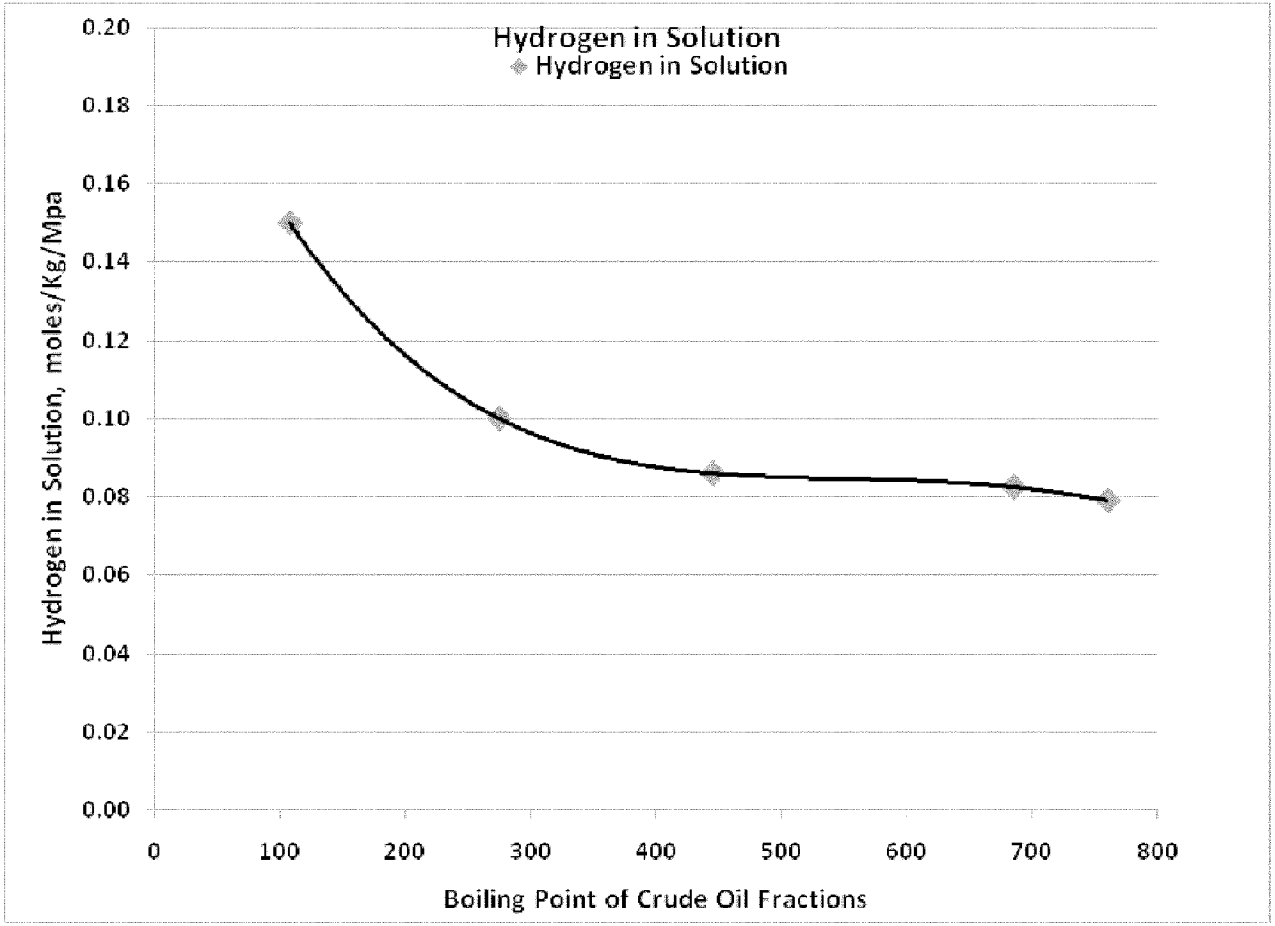
FIG. 5 is a plot of hydrogen solubility versus the boiling point of crude oil fractions.

In the operation of system 10, a heavy hydrocarbon feedstock is introduced into mixing unit 20 via conduit 21, along with a predetermined amount of fresh hydrogen gas introduced via conduit 24, and optionally, a predetermined amount of homogeneous catalyst introduced via conduit 22. The contents are retained in mixing unit 20 for a predetermined period of time, and under suitable operating conditions, to permit a desired quantity of hydrogen to be dissolved in the liquid hydrocarbon feedstock. As shown in FIG. 5, hydrogen is more soluble in comparatively lighter, i.e., lower boiling temperature, fractions. The amount of dissolved hydrogen depends on the feedstock composition, rate of conversion and operating conditions, and can be adjusted accordingly.

An effluent is discharged via outlet 28 to inlet 31 of flashing unit 30 in the form of a two-phase mixture containing a liquid phase of hydrogen-enriched hydrocarbons and a gas phase of excess undissolved hydrogen. In flashing unit 30, excess gas-phase hydrogen is recovered and discharged via outlet 33 and conduit 25 for optional recycle to mixing unit 20. The liquid phase including hydrocarbons having hydrogen dissolved therein is conveyed via outlet 35 to inlet 41 of hydrovisbreaking reactor 40.

In general steam or water can be introduced into hydrovisbreaking reactor 40 via inlet 42 at a rate in the range of from 0.1 volume % (V %) to 10.0 V % of feedstock, and in certain embodiments about 0.25 V % of feedstock. Steam vaporizes immediately and creates a higher fluid velocity, which reduces the formation of coke.

Hydrovisbreaking reactor effluent is discharged via outlet 43 to inlet 51 of separation unit 50, from which a gas stream containing hydrogen and light hydrocarbons are discharged via outlet 53 and a liquid phase stream containing cracked, uncracked and partially converted heavy residua is discharged via outlet 55. Process water is discharged via outlet 56.

Part of the liquid hydrocarbon stream is recycled back to the mixing vessel 20 via conduit 23 to provide sufficient hydrocarbons to dissolve hydrogen in the liquid blend.

The recycle of hydrocarbon stream via conduit 23 can be in the range of from 50-150 V % of the initial hydrocarbon feedstock introduced via conduit 21. A surge vessel (not shown) can be used to accumulate the recycle stream when the ratio of recycle is high. The remainder of the liquid phase stream containing cracked, uncracked and partially converted heavy residua is conveyed to fractionating unit 60 to separate the visbroken hydrocarbons into, for instance, naphtha via outlet 63, gas oil via outlet 65, and bottoms via outlet 67. Any remaining solid catalyst is passed with the fractionator bottoms via outlet 67. A portion of the heavy bottom product can be recycled to the mixing unit 20 via conduit 69 for further treatment.

Mixing unit 20 can be a column equipped with spargers and/or distributors. The operating conditions include a pressure in the range of from about 40 bars to about 200 bars; a temperature in the range of from about 40° C. to about 300° C.; and a ratio of the normalized volume of hydrogen (i.e., the volume of hydrogen gas at 0° C. and at 1 bar) to the volume of feedstock in the range of from about 30:1 to about 3000:1 and in certain embodiments from about 300:1 to about 3000:1.

Flash unit 30 can be a single equilibrium stage distillation vessel. The operating conditions include a pressure in the range of from about 10 bars to 200 bars, in certain embodiments about 10 bars to 100 bars, and in further embodiments about 10 bars to 50 bars; a temperature in the range of from about 350° C. to about 600° C., in certain embodiments about 375° C. to about 550° C., and in further embodiments about 400° C. to about 500° C.

The hydrovisbreaking reactor can be a 'coil' or 'furnace' type reactor, or a 'soaker' type reactor, and can be continuous flow plug-flow, slurry, or batch. In embodiments in which hydrovisbreaking reactor 40 operates as a coil process, conversion is achieved by high temperature cracking for a predetermined, relatively short period of time. In general, the operation conditions for a coil hydrovisbreaking reactor include a residence time from about 0.1 to about 60 minutes, in certain embodiments about 0.5 to about 10 minutes, and in further embodiments about 1 to about 5 minutes; a pressure from about 10 bars to 200 bars, in certain embodiments about 10 bars to 100 bars, and in further embodiments at about 10 bars to 50 bars; a temperature from about 350° C. to about 600° C., in certain embodiments about 375° C. to about 550° C., and in further embodiments about 400° C. to about 500° C.; and a severity index from about 0.1 minutes to 500 minutes, in certain embodiments about 1 minute to about 100 minutes, and in further embodiments about 5 minutes to about 15 minutes.

In embodiments in which hydrovisbreaking reactor 40 operates as a soaker process, the majority of conversion occurs in a reaction vessel or a soaker drum in which the contents are maintained at a relatively lower temperature for a longer period of time as compared to hydrocracking operations. In general, the operation conditions for a soaker hydrovisbreaking reactor include a residence time from about 1 to about 120 minutes, in certain embodiments about 1 to about 60 minutes, and in further embodiments about 1 to about 30 minutes; a pressure from about 10 bars to 200 bars, in certain embodiments about 10 bars to 100 bars, and in further embodiments about 10 bars to about 50 bars; a temperature from about 350° C. to about 600° C., in certain embodiments about 375° C. to about 550° C., and in further embodiments about 400° C. to about 500° C.

The initial heavy hydrocarbon feedstock can be from crude oil, coal liquefaction processes and other refinery intermediates boiling above 370° C., including straight run atmospheric or vacuum bottoms, coking gas oils, FCC cycle oils, deasphalted oils, bitumens from tar sands and/or its cracked products, and coal liquids.

The catalysts can be homogeneous catalysts including elements from Group IVB, VB and VIB of the Periodic Table. The catalysts can be provided as finely dispersed solid or soluble organometallic complexes, such as molybdenum naphthalene, on a support material.

While not wishing to be bound by theory, it is believed the process described herein follows a free radical reaction mechanism. Dissolved hydrogen atomizes with the feedstock and is readily available for cleavage and recombination reactions. For example, in the presence of hydrogen, the cleavage of the C—C bond in an n-paraffin molecule produces two primary radicals, as depicted in the scheme of Reaction 1 below. These primary radicals react selectively with hydrogen to produce lower molecular weight hydrocarbons and hydrogen radicals in a short residence time, e.g., as in Reactions 2 and 3. The hydrogen radicals propagate the chain by cleaving hydrogen from other hydrocarbon molecules and producing secondary radicals, as in Reaction 4. Further reaction, i.e., splitting, of the secondary radicals occurs and yields a primary radical and a 1-olefin, as in Reaction 5. The primary radical is then saturated by hydrogen to yield a hydrocarbon with regeneration of the reaction chain as depicted in Reaction 6. The process described herein uses soluble homogeneous catalyst to facilitate and enhance these hydrogen transfer reactions.

$$R—(CH_2)_6—R' \rightarrow R—CH_2—CH_2—CH_2.+.CH_2—CH_2—CH_2—R' \quad (1)$$

$$R—CH_2—CH_2—CH_2.+H2 \rightarrow R—CH_2—CH_2—CH_3+H. \quad (2)$$

$$.CH_2—CH_2—CH_2—R'+H2 \rightarrow CH_3—CH_2—CH_2—R'+H. \quad (3)$$

$$H.+R—(CH_2)_6—R' \rightarrow R—(CH_2)—CH.—(CH_2)_4—R+H_2 \quad (4)$$

$$R—(CH_2)—CH.(CH_2)_4—R' \rightarrow R—CH_2—CH.+CH_2=CH_CH_2—CH_2—R' \quad (5)$$

$$R—CH_2—CH.+H_2 \rightarrow R—CH_2—CH_3+H. \quad (6)$$

Distinct advantages are provided by the present apparatus and system. A substantial portion of the hydrogen required for the hydrovisbreaking process is dissolved in the liquid feedstock upstream of the hydrovisbreaking reactor in a mixing zone, such that hydrogen is mixed with a hydrocarbon feedstock and all or a substantial portion of the gas phase is separated from hydrogen-enriched liquid feedstock in a flash zone prior to hydrovisbreaking. Dissolved hydrogen in the hydrogen-enhanced liquid hydrocarbon feedstock provides a substantially single-phase feed to the hydrovisbreaking reactor and enhances conventional hydrovisbreaking processes by stabilizing free radicals formed during the cracking reactions, resulting in improved product yield. In addition, the required reactor vessel design volume is reduced and the gas recycle system is substantially minimized or eliminated, as compared to conventional two-phase visbreaker unit operations, thereby reducing capital costs.

Requisite hydrogen consumption for a hydrovisbreaking process with a hydrodesulfurization function is demonstrated below. Sufficient hydrogen can be dissolved in a visbreaker feed to improve efficiency and thereby increase the yield of the desired products. In the process described herein, the hydrovisbreaking process is not designed to maximize the hydrogenation or hydrodesulfurization function; rather, the hydrovisbreaking process is a relatively low conversion process to decrease the viscosity of oils for transportation purposes.

The material balance for hydrodesulfurization is shown in Table 1. As seen, two moles of hydrogen are required for one mole of sulfur removal. One mole of hydrogen is added to sulfur to produce one mole of hydrogen sulfide, and one mole of hydrogen is added to the hydrocarbon molecule, where sulfur is extracted in accordance with the reaction scheme: $C_4H_4S+2\ H_2 \rightarrow H_2S+C_4H_6$.

The vacuum residue in this example has 4.2 weight % (W %) of sulfur and it is desulfurized by 13 W %. At this desulfurization level, the sulfur removed from the molecule is 0.546 g/100 g of oil. This translates into 0.0170 g-mole of sulfur per 100 g of oil, and 0.0341 moles or 0.0687 g of hydrogen per 100 g of oil are needed.

TABLE 1

Hydrogen consumption calculation for hydrodesulfurization reactions

| Reaction | | S | $H_2$ | → | $H_2S$ |
|---|---|---|---|---|---|
| Moles Required/ Produced | | 1 | 2 | | 1 |
| Feedstock Sulfur Content | W % | 4.2 | | | |
| Molecular Weight | g/mol | 32.060 | 2.016 | | 34.076 |
| Hydrodesulfurization | W % | 13 | | | |
| Remaining Sulfur | g/100 g | 0.546 | | | |
| | g-mol/100 g | 0.0170 | | | |
| Hydrogen Required | g-mol/100 g | | 0.0341 | | |
| | g/100 g | | 0.0687 | | |
| | g/Kg | | 0.6866 | | |

The combined hydrogen consumption is tabulated in Table 2. The total hydrogen consumed is 0.1826 moles per Kg of oil.

TABLE 2

| Reaction | Unit | Value |
|---|---|---|
| Hydrocracking | moles/Kg | 0.1139 |
| Hydrodesulfurization | moles/Kg | 0.0687 |
| Total | moles/Kg | 0.1826 |

Table 3 summarizes the total flow rate for the hydrogen-enriched vacuum residue liquid feed mixture. The hydrogen in the gas phase that is flashed off is excluded from this calculation.

TABLE 3

| | | |
|---|---|---|
| Total Molar Rate | KG-MOL/HR | 15.4 |
| Total Mass Rate | KG/HR | 9661.9 |

Table 4 summarizes the individual flow rates for vacuum residue and hydrogen introduced into the mixing zone. The amount of hydrogen dissolved in the system is 0.267 moles/kg of oil. Thus sufficient hydrogen is present in the system without recycling hydrogen gas.

TABLE 4

| Flow Rates | | | |
|---|---|---|---|
| | Flow rate (Mol/h) | Flow rate (Kg/h) | Hydrogen/Oil Ratio Mole/Kg |
| Vacuum Residue | 12837.1 | 9656.7 | |
| Hydrogen | 2576.4 | 5.2 | 0.267 |
| Total | 15413.5 | 9661.8 | |

EXAMPLE

Computer simulations were conducted to demonstrate the process described herein using PRO II (version 8.3) software by SimSci-Esscor that is commercially available from Invensys Operations Management of London, England (ips.invensys.com). The thermodynamic system selected was a Grayson-Street. The feedstock was an Arab light vacuum residue. Hydrogen gas and feedstock were mixed in a mixing unit for a sufficient time to produce a two-phase mixture of hydrogen gas and hydrogen-enriched liquid hydrocarbon feedstock. The mixture of hydrogen gas and hydrogen-enriched liquid hydrocarbon feedstock is then introduced into a flashing zone to separate the undissolved hydrogen gas and any light components, and recover a single-phase hydrogen-enriched liquid hydrocarbon feedstock. The simulation was carried out at a constant hydrogen-to-oil ratio of 1160 standard liter/liter of oil (sLt/Lt), a flash temperature of 500° C., and incrementally increased pressures in flashing zone in the range of from 10-200 $Kg/cm^2$. Hydrogen content in the single-phase hydrogen-enriched liquid hydrocarbon feedstock at the various pressures is shown in Table 5.

TABLE 5

| Pressure | Hydrogen, M % | Hydrogen W % |
|---|---|---|
| 10 | 0.0300 | 0.0037 |
| 20 | 0.0590 | 0.0076 |
| 30 | 0.0880 | 0.0117 |
| 40 | 0.1160 | 0.0159 |
| 50 | 0.1430 | 0.0203 |
| 80 | 0.2210 | 0.0346 |
| 100 | 0.2700 | 0.0451 |
| 130 | 0.3390 | 0.0625 |
| 150 | 0.3820 | 0.0755 |
| 200 | 0.4820 | 0.1135 |

The single-phase hydrogen-enriched liquid hydrocarbon feedstock was then passed to a hydrovisbreaking reaction unit, which is operated at 460° C. and a severity index of 5 to improve its viscosity to 50 time of the feedstock. Product yield is shown in Table 6 below.

TABLE 6

| Fractions | Cut Points, ° C. | Yield |
|---|---|---|
| $H_2S$ | | 0.6 |
| $C_1$-$C_4$ | | 1.40 |
| Naphtha | 36-180 | 8.6 |
| Gas Oil | 180-370 | 8.0 |
| VGO | 370-520 | 22.9 |
| Residue | 520+ | 58.5 |
| Total | | 100.00 |

The method and system of the present invention have been described above and in the attached drawings; however, modifications will be apparent to those of ordinary skill in the art and the scope of protection for the invention is to be defined by the claims that follow.

The invention claimed is:

1. A process for reducing the viscosity of a liquid hydrocarbon feedstock into lower molecular weight hydrocarbon compounds in a hydrovisbreaking reaction zone comprising:

a. mixing the liquid hydrocarbon feedstock and an excess of hydrogen gas in a mixing zone to dissolve a portion of the hydrogen gas in the liquid hydrocarbon feedstock and produce a two-phase mixture of a hydrogen-enriched liquid hydrocarbon feedstock and the remaining excess hydrogen gas;

b. introducing the mixture of hydrogen gas and the hydrogen-enriched liquid hydrocarbon feedstock into a flashing zone under predetermined conditions to separate the undissolved excess hydrogen gas and optimize the amount of hydrogen dissolved in the hydrogen-enhanced liquid hydrocarbon feedstock, and recovering a single-phase hydrogen-enriched liquid hydrocarbon feedstock;

c. conveying the single-phase hydrogen-enriched liquid hydrocarbon feedstock under conditions that maximize the amount of dissolved hydrogen in the hydrocarbon feedstock into a hydrovisbreaking reaction zone in the presence of steam to crack the feedstock into relatively smaller molecules; and d. recovering converted hydrocarbon products of reduced viscosity from the hydrovisbreaking reaction zone.

2. The process of claim 1, which further comprising adding a catalyst to the feedstock in the form of finely dispersed solid material or soluble catalyst in the hydrocarbon feedstock.

3. The process of claim 2, in which the catalyst is selected from the group consisting of elements from Group IVB, VB and VIB of the Periodic Table.

4. The process of claim 2, in which the soluble catalyst includes one or more of organometallic complexes.

5. The process of claim 1, wherein the mixing zone is operated at a pressure in the range of from about 40 bars to about 200 bars.

6. The process of claim 1, wherein the mixing zone is operated at a temperature in the range of from about 40° C. to about 300° C.

7. The process of claim 1, wherein the mixing zone is operated at a ratio of the normalized volume of hydrogen to the volume of feedstock in the range of from about 300:1 to about 3000:1.

8. The process of claim 1, further comprising introducing liquid water or steam to the hydrovisbreaking reaction zone at a rate in the range of from 0.1 volume % to 10.0 volume % of feedstock.

9. The process of claim 1, further comprising recycling a portion of the converted hydrocarbon products back to the mixing zone at a rate in the range of from 50-150volume % of the initial hydrocarbon feedstock.

10. The process of claim 1, wherein the feedstock includes crude oil, straight run atmospheric or vacuum bottoms, coking gas oils, FCC cycle oils, deasphalted oils, bitumens from tar sands and/or its cracked products, and coal liquids coal liquefaction processes and other refinery intermediates boiling above 370° C.

11. The process of claim 1, wherein the flashing zone is operated at a pressure in the range of from about 10 bars to 200 bars.

12. The process of claim 1, wherein the flashing zone is operated at a pressure in the range of from about 10 bars to 100 bars.

13. The process of claim 1, wherein the flashing zone is operated at a pressure in the range of from about 10 bars to 50 bars.

14. The process of claim 1, wherein the flashing zone is operated at a temperature in the range of from about 350° C. to about 600° C.

15. The process of claim 1, wherein the flashing zone is operated at a temperature in the range of from about 375° C. to about 550° C.

16. The process of claim 1, wherein the flashing zone is operated at a temperature in the range of from about 400° C. to about 500° C.

17. The process of claim 1, which further comprising adding a catalyst to the feedstock in the form of finely dispersed solid material and wherein the catalyst is selected from the group consisting of elements from Group IVB, VB and VIB of the Periodic Table.

* * * * *